US006527564B1

(12) United States Patent
Yeh

(10) Patent No.: US 6,527,564 B1
(45) Date of Patent: Mar. 4, 2003

(54) ELECTRICAL CONNECTOR HAVING PRINTED CIRCUIT BOARD

(75) Inventor: Ryan Yeh, Chino Hills, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/050,805

(22) Filed: Jan. 15, 2002

(51) Int. Cl.[7] ..... H01R 12/20
(52) U.S. Cl. ..... 439/76.1; 439/79; 439/607
(58) Field of Search ..... 439/76.1, 79, 607, 439/609, 541.5

(56) References Cited

U.S. PATENT DOCUMENTS 5,643,008 A * 7/1997 Tan et al. ..... 439/541.5
5,709,568 A * 1/1998 Pan et al. ..... 439/541.5
5,713,747 A * 2/1998 Hsia et al. ..... 439/541.5
5,775,923 A * 7/1998 Tomioka ..... 439/541.5
5,954,522 A * 9/1999 Ho et al. ..... 439/79
6,062,904 A * 5/2000 Oguchi et al. ..... 439/76.1
6,089,878 A * 7/2000 Meng ..... 439/79
6,095,853 A * 8/2000 Huang et al. ..... 439/541.5

* cited by examiner

*Primary Examiner*—Gary Paumen
(74) *Attorney, Agent, or Firm*—Wei Te Chung

(57) ABSTRACT

An electrical connector (1) includes an insulative housing (2), a number of electrical contacts (3), a conductive front shield (4), a printed circuit board (5), a terminal insert (6), a pair of boardlocks (7), a pair of nuts (8), and a conductive rear shield (9) assembled to the insulative housing. The electrical contacts are mounted to the insulative housing and each has a contact portion (30) shielded by the conductive front shield and a mounting portion (42) electrically connected with the printed circuit board. The contact insert includes an insulative portion (60) assembled to the insulative housing and a number of electrical terminals (62) retained to the insulative portion and electrically connected with the printed circuit board. The nuts secure the boardlocks, the insulative housing and the conductive front shield together.

1 Claim, 4 Drawing Sheets

ELECTRICAL CONNECTOR HAVING PRINTED CIRCUIT BOARD

BACKGROUND OF THE INVENTION

1. Field of the Invention

The present invention relates to an electrical connector, and particularly to an electrical connector having a printed circuit board mounted therein.

2. Description of the Related Art

Electrical connectors are often mounted on printed circuit boards, for example mother boards, of electronic devices, for example personal computers, to communicate external or internal electronic devices outside or inside mainframes of the electronic devices with electronic elements mounted on the mother boards by way of electrically engaging with complementary electrical connectors which electrically connect with the external or internal electronic devices, and electrically connecting with electrical circuits in the mother boards which electrically connect with the electronic elements. In this way, the electrical connector, the electrical circuit and the electronic element respectively occupy 'real estate' on the mother board and unavoidably consume precious and limited space of the mother board, which is obviously in violation of the present miniaturization trend in the electronic field. Therefore, a solution to the above problem is desired.

SUMMARY OF THE INVENTION

A major object of the present invention is to provide an electrical connector incorporating therein a printed circuit board to save the space of a printed circuit board to which the electrical connector is mounted.

An electrical connector in accordance with the present invention comprises an insulative housing, a plurality of electrical contacts, a conductive front shield, a printed circuit board, a terminal insert, a pair of boardlocks, a pair of nuts and a conductive rear shield assembled to the insulative housing. The electrical contacts are mounted to the insulative housing and each comprises a contact portion shielded by the conductive front shield and a mounting portion. The printed circuit board is secured to the insulative housing and electrically connects with the mounting portions of the electrical contacts. The nuts secure the boardlocks, the insulative housing and the conductive front shield together. The terminal insert comprises an insulative portion assembled to the insulative housing and a plurality of electrical terminals retained to the insulative portion and electrically connected with the printed circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
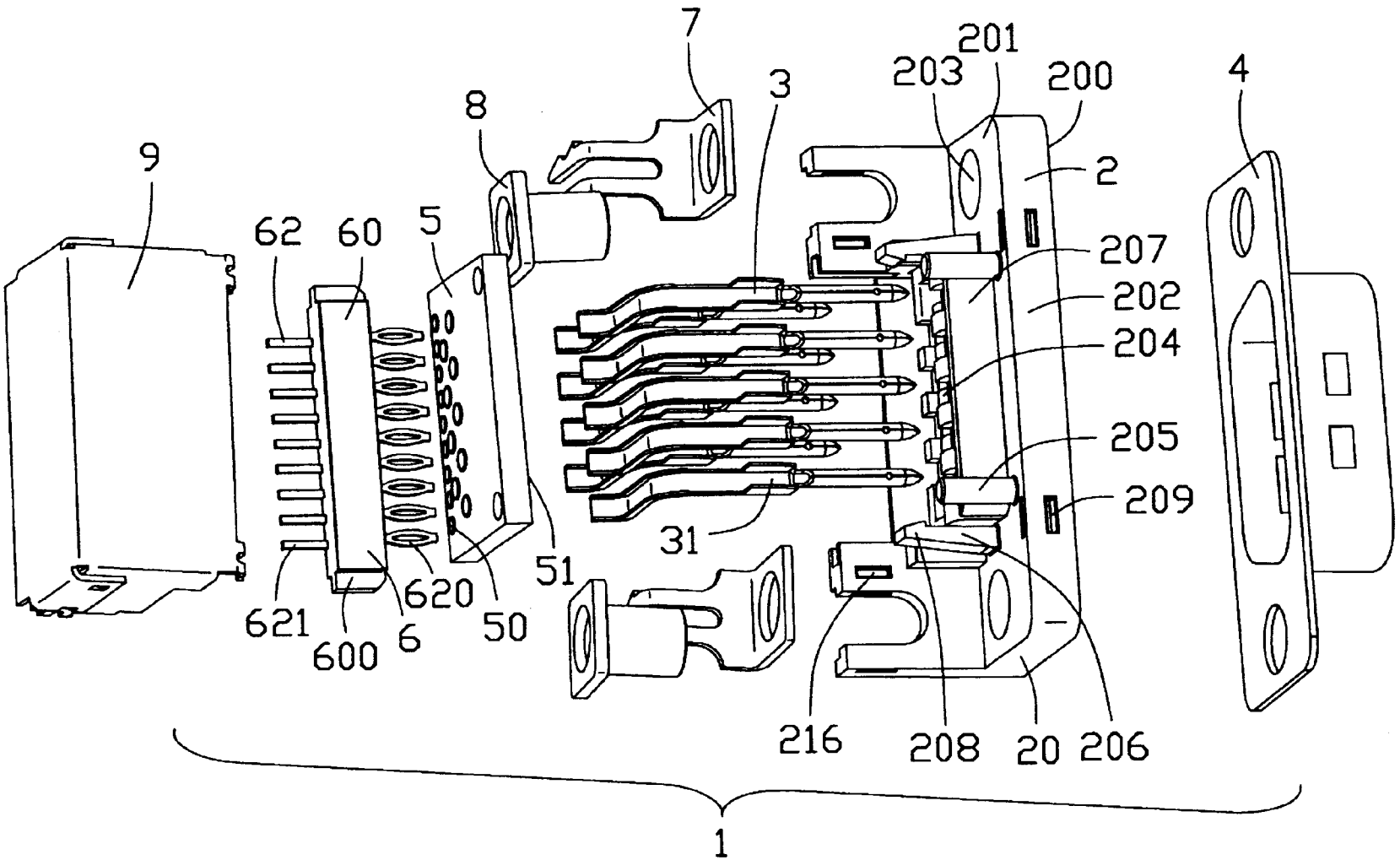
FIG. 1 is an exploded perspective view of an electrical connector in accordance with the present invention.
Figure 2:
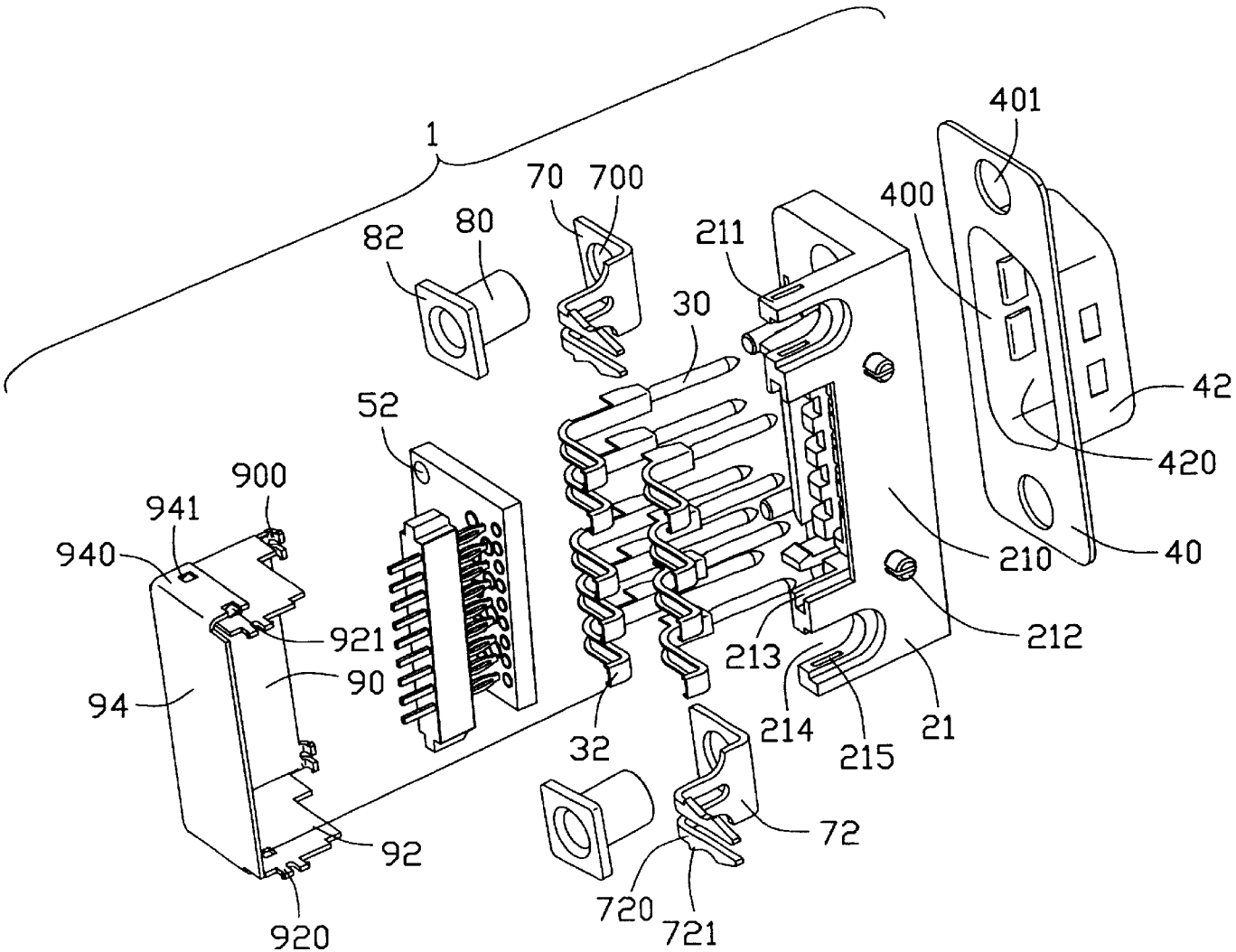
FIG. 2 is a view similar to FIG. 1 but taken from another perspective.

Referring to FIGS. 1 and 2, an electrical connector 1 in accordance with the present invention comprises an insulative housing 2, a plurality of electrical contacts 3, a conductive front shield 4, a printed circuit board 5, a terminal insert 6, a pair of boardlocks 7, a pair of nuts 8, and a conductive rear shield 9.

The insulative housing 2 is generally L-shaped and comprises a vertical portion 20 and a horizontal portion 21 extending perpendicularly and rearwardly from a lower end of the vertical portion 20. The vertical portion 20 defines a front face 200, a rear face 201 opposite to the front face 200, a top face 202 connecting with the front and the rear faces 200, 201, a pair of through holes 203 extending through the front and the rear faces 200, 201 at longitudinal opposite sides thereof, and a plurality of passageways 204 extending through the front and the rear faces 200, 201 and located between the through holes 203. The vertical portion 20 is formed with a pair of posts 205 extending rearwardly from the rear face 201 thereof, a pair of latches 206 located below and sidewardly of the posts 205 and a supporting plate 207 above the passageways 204. The posts 205 and the latches 206 extend rearwardly longer than the supporting plate 207. Each latch 206 extends rearwardly and slightly inwardly toward another latch 206 and comprises a hook section 208 at a rear end thereof. The top face 202 is defined with a pair of slits 209 recessed therefrom.

The horizontal portion 21 comprises a tongue 210 and a pair of extensions 211 extending at two opposite sides of the tongue 210. The tongue 210 is formed with a pair of positioning pins 212 extending downwardly from a bottom surface thereof to position the electrical connector 1 to a printed circuit board (not shown) to which the electrical connector 1 is mounted. Each extension 211 comprises a groove 213 defined in an inner side surface thereof, a channel 216 defined in a top surface thereof, a U-shaped cutout 214 outwardly beside the groove 213 and the channel 216 and opening rearwardly, and a pair of opposite slots 215 defined in inner surfaces of side walls of the U-shaped cutout 214.

Each of the electrical contacts 3 comprises a contact portion 30, a fixing portion 31 extending rearwardly from the contact portion 30 and a mounting portion 32 extending rearwardly from the fixing portion 31.

The conductive front shield 4 comprises a mounting plate 40 and a mating portion 42 extending forwardly from the mounting plate 40. The mounting plate 40 defines an opening 400 in a center section thereof and a pair of apertures 401 located at two opposite sides thereof. The mating portion 42 is generally frame-shaped and defines a mating cavity 420 corresponding to the opening 400.

The printed circuit board 5 is generally rectangular and defines three rows of solder holes 50 in a lower portion thereof and a pair of passages 52 in an upper portion thereof. The solder holes 50 could, as known to persons of ordinary skill in the pertinent art, also be solder pads, if desired.

The terminal insert 6 comprises an insulative portion 60 and a plurality of electrical terminals 62 insert molded in the insulative portion 60. The insulative portion 60 comprises a pair of flanges 600 extending outwardly from two opposite sides thereof. Each terminal 62 comprises a retention portion (not shown) fixed in the insulative portion 60, a compliant portion 620 extending forwardly from the retention portion beyond a front face of the insulative portion 60, and a solder portion 621 extending rearwardly from the retention portion beyond a rear face of the insulative portion 60. The compliant portions 620 are shown herein generally in needle-eyes fashion, but can also be in other fashions, as desired, so long as compliant retentions can be achieved. Furthermore, the compliant portion 620 can also not be in compliant fashions to be in SMT (Surface Mount Technology) or THT (Through Hole Technology) fashions.

Each boardlock 7 comprises an abutting portion 70 defining a hole 700 therein and a locking portion 72 extending from the abutting portion 70. The locking portion 72 is formed with a pair of spaced legs 720 and a plurality of barbs 721 extending outwardly from outer sides of the legs 720.

Each nut 8 comprises a base portion 82 and an insert portion 80 extending forwardly from the base portion 82.

The conductive rear shield 9 comprises a top wall 90, a pair of side walls 92 extending downwardly from two opposite sides of the top wall 20, and a rear wall 94 extending downwardly from a rear side of the top wall 90. The top wall 90 is formed with two pairs of spaced top fingers 900 extending from a front side thereof. Each side wall 92 is formed with a pair of spaced side fingers 920 extending downwardly from a lower end thereof and a pair of tabs 921 located adjacent to a rear portion thereof. The rear wall 94 comprises a pair of side flanges 940 extending forwardly to overlap the rear portions of the side walls 92 and a pair of windows 941 defined in each side flange 940 to be engageable with the tabs 921 of the side walls 92 for providing a retention between the rear wall 94 and the side walls 92.

Figure 3:
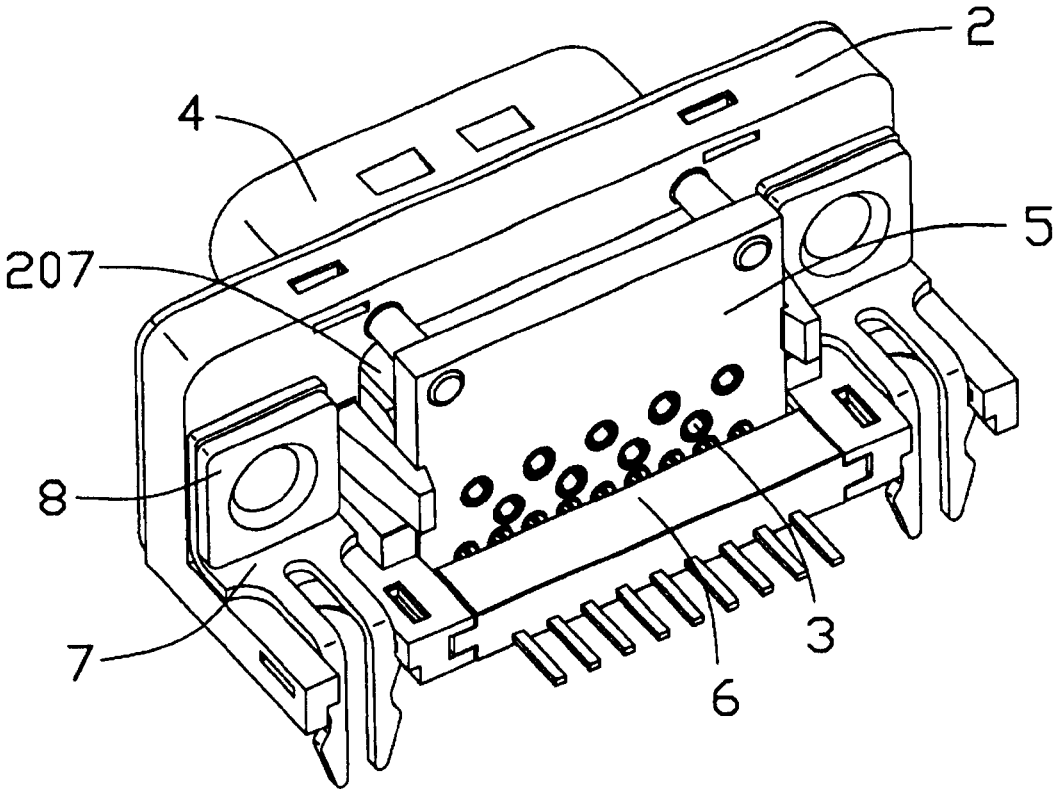
FIG. 3 is an assembled perspective view of the electrical connector of FIG. 1 without a rear shield.
Figure 4:
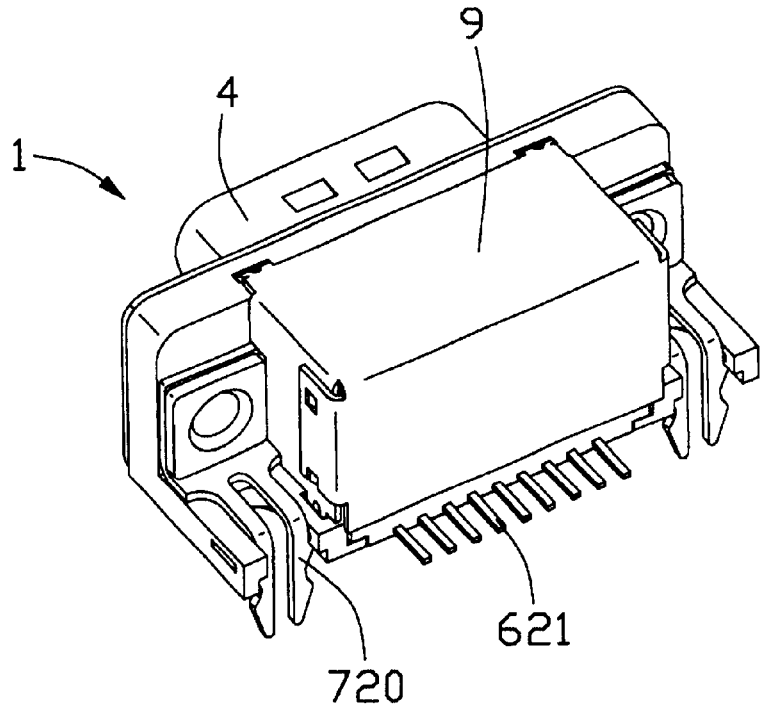
FIG. 4 is a view similar to FIG. 3 but the rear shield has been assembled thereto.
Figure 5:
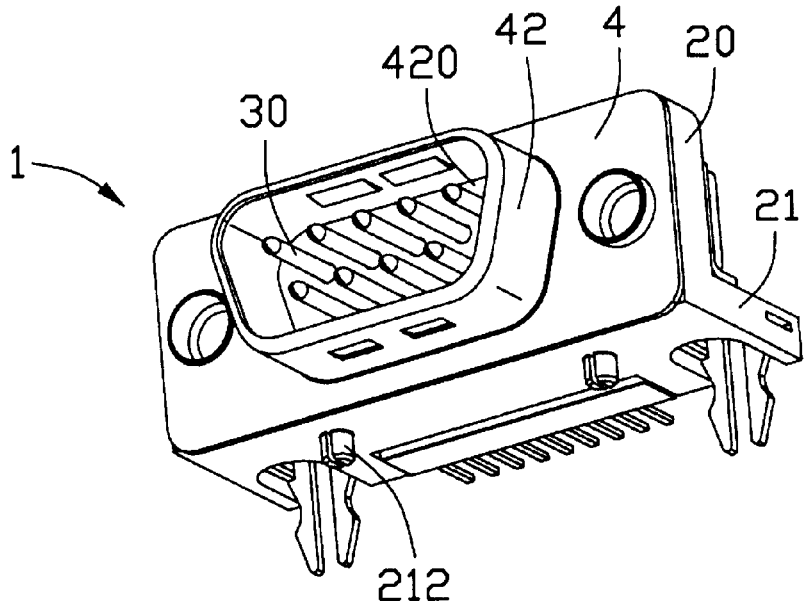
FIG. 5 is a view similar to FIG. 4 but taken from another perspective.

Referring also to FIGS. 3–5, in assembly, the fixing portions 31 of the electrical contacts 3 are retained in the passageways 204 of the vertical portion 20 of the insulative housing 2 while the contact and the mounting portions 30, 32 extend respectively beyond the front and the rear faces 200, 201 of the vertical portion 20. The insert portions 80 of the nuts 8 are inserted through the holes 700, the through holes 203, and the apertures 401 of the boardlocks 7, the insulative housing 2 and the conductive front shield 4, respectively, until the base portions 82 are stopped by the abutting portions 70, which abut against the rear face 201 of the vertical portion 20 of the insulative housing 2, to secure the boardlocks 7, the insulative housing 2 and the conductive front shield 4 together.

The mounting plate 40 of the conductive front shield 4 abuts against the front face 200 of the vertical portion 20 while the mating portion 42 of the conductive front shield 4 encircles the contact portions 30 of the electrical contacts 3 in the mating space 420 thereof to provide an Electromagnetic Interference (EMI) shielding thereto. The legs 720 of the boardlocks 7 extend downwardly through the U-shaped cutouts 214 of the horizontal portion 21 of the insulative housing 2 with the barbs 721 thereof interferentially engaging with the side surfaces of the U-shaped cutouts 214 to provide a retention therebetween.

The posts 205 of the insulative housing 2 extend through the passages 52 of the printed circuit board 5 until a front face 51 of the printed circuit board 5 is abutted against the supporting plate 207 and is thereby stopped from further forwardly moving. The mounting portions 32 of the electrical contacts 3 are mechanically mounted and electrically connected to the printed circuit board 5 by means of two rows of the solder holes 50 in ways known to persons skilled in the pertinent art. The printed circuit board 5 is supported by the tongue 210 of the horizontal portion 21 and is prevented from rearwardly moving by the hook sections 208 of the latches 206.

The flanges 600 of the insulative portion 60 of the terminal insert 6 are received in the grooves 213 of the extensions 211 of the horizontal portion 21 of the insulative housing 2. The compliant portions 620 of the electrical terminals 62 of the terminal insert 6 are retained in the rest row of solder holes 50 of the printed circuit board 5 to provide an electrical connection therebetween.

The top fingers 900 of the top wall 90 and the side fingers 920 of the side walls 92 of the conductive rear shield 9 engage with the slits 209 of the vertical portion 20 and the channels 216 of the horizontal portion 21 of the insulative housing 2, respectively, to secure the conductive rear shield 9 to the insulative housing 2. As is clearly shown in FIG. 4, the conductive rear shield 9 encloses therein the mounting portions 32 of the electrical contacts 3, the printed circuit board 5 and the compliant portions 620 of the electrical terminals 62 of the terminal insert 6 to provide an EMI shielding thereto.

The printed circuit board 5 incorporates therein some electrical circuits (not shown) and electronic elements (not shown) which are originally disposed to the printed circuit board to which the electrical connector 1 is mounted, so the space of the printed circuit board is saved by the electrical connector 1 incorporating the printed circuit board 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a vertical portion defining a front face and a rear face opposite to the front face;

a plurality of electrical contacts being retained to the vertical portion of the insulative housing, each electrical contact comprising a contact portion extending beyond the front face of the vertical portion and a mounting portion extending beyond the rear face of the vertical portion;

a conductive front shield being attached to the front face of the vertical portion and comprising a mating portion encircling the contact portions of the electrical contacts therein;

a printed circuit board being electrically connected with the mounting portions of the electrical contacts; and a plurality of electrical terminals electrically connecting with the printed circuit board;

wherein the vertical portion of the insulative housing is formed with a pair of posts and the printed circuit board defines a pair of pass ages for the posts to extend therethrough;

wherein the vertical portion is formed with a pair of latches each comprising a hook section for retaining the printed circuit board;

further comprising a conductive rear shield having a pair of side walls formed with a plurality of side fingers, and wherein the insulative housing comprises a horizontal portion extending from the vertical portion and defining a pair of channels engaging with the side fingers;

wherein the conductive rear shield comprises atop wall connected with the side walls and comprising a plurality of top fingers, and the vertical portion of the insulative housing defines a pair of slits to engage with the top fingers;

further comprising a pair of nuts and a pair of boardlocks each defining a hole therein, and wherein the conductive front shield and the vertical portion of the insulative housing respectively comprise a pair of apertures and a pair of through holes, each nut comprising an insert portion extending sequentially through the hole, the through hole, and the aperture to secure the boardlock, the insulative housing and the conductive front shield together;

further comprising an insulative portion, and wherein the electrical terminals are retained to the insulative portion;

wherein each electrical terminal comprises a compliant portion and the printed circuit board comprises a plurality of solder holes to receive the compliant portions of the electrical terminals.

* * * * *